US006347672B1

(12) United States Patent
Reardon

(10) Patent No.: US 6,347,672 B1
(45) Date of Patent: Feb. 19, 2002

(54) STAKE/POST DRIVER

(76) Inventor: Patrick Reardon, 2308 Hibiscus Ave., Seffner, FL (US) 33584

( * ) Notice: Subject to any disclaimer, the term of this patent is extended or adjusted under 35 U.S.C. 154(b) by 0 days.

(21) Appl. No.: 09/453,129

(22) Filed: Dec. 2, 1999

(51) Int. Cl.[7] ..... B25D 1/04
(52) U.S. Cl. ..... 173/90; 173/132
(58) Field of Search ..... 173/90, 91, 29, 173/132, 128, 126

(56) References Cited

U.S. PATENT DOCUMENTS 2,703,479 A * 3/1955 Richardson ..... 173/132
3,117,378 A * 1/1964 Bowen ..... 173/90
4,701,077 A * 10/1987 Arentsen ..... 173/91
5,010,710 A * 4/1991 Gray et al. ..... 173/90
5,050,286 A * 9/1991 Miyanaga ..... 173/90
5,542,479 A * 8/1996 Stachler et al. ..... 173/132
5,662,386 A * 9/1997 Newman et al. ..... 173/90

* cited by examiner

*Primary Examiner*—Scott A. Smith
(74) *Attorney, Agent, or Firm*—Arthur W. Fisher, III

(57) ABSTRACT

A stake/post driver for use with a handheld jackhammer comprising a hammer assembly including a hammer element configured to strike the upper portion of the stake or post coupled to the handheld jackhammer by a hammer spindle to mechanically drive a stake or post into the ground or other support surface and a hammer guide assembly including a hammer housing to receive the hammer element and a portion of the hammer spindle therein having an upper spindle guide formed on the upper portion thereof to receive a portion of the hammer spindle therethrough and a lower stake/post guide coupled to the lower portion thereof to receive a portion of the stake or post therethrough to cooperatively align the hammer element relative to the stake or post during operation of the stake/post driver such that the hammer element strikes the upper portion of the stake or post driving the stake or post into the ground or other support surface.

31 Claims, 3 Drawing Sheets

STAKE/POST DRIVER

BACKGROUND OF THE INVENTION

1. Field of the Invention

A stake/post driver for use with a handheld jack hammer to mechanically drive a stake or post into the ground or other support surface.

2. Description of Prior Art

Driving posts into the ground can be a labor intensive job. It would of course be a benefit to have a mechanical device that could be placed over the upwardly directed end of a post to be driven into the ground that would provide a hammering force to the upwardly directed end of sufficient force and frequency to drive the downwardly directed post end into the ground to the desired depth. Because posts must often be driven into the ground at remote locations, such as when erecting fences and the like, it would be a further benefit to have a post driving device that was lightweight.

U.S. Pat. No. 5,806,608 shows an air-driven post driver that includes a hammer assembly and post receiving assembly. The hammer assembly includes an air-driven piston hammer slidably disposed within a cylinder bore of a cylinder body having a circumference compressed air groove of a first groove width formed into a cylinder wall that defines the cylinder bore and an upper discharge port and a lower discharge port. The piston hammer includes an upward thrusting air passageway and a downward thrusting air passageway. The upward thrusting air passageway includes a radially oriented upward intake passageway and a longitudinally oriented upward discharge passageway. The upward discharge passageway is a length greater than one half the length of the piston hammer. The downward thrusting passageway includes a radially oriented downward intake passageway and a longitudinally oriented downward discharge passageway having a threaded downward discharge port. The downward discharge passageway is of a length greater than one-half the length of the piston hammer.

U.S. Pat. No. 5,494,117 teaches a metal fence post driving apparatus formed by a platform rearwardly supported by the three point hitch of a conventional tractor and having a fluid pressure generating unit on the platform driven by the tractor power takeoff. A mast having a top end portion rotatable about its vertical axis pivotally supports a boom intermediate its ends for horizontal and vertical pivoting movement of its respective end portions by a first fluid pressure operated cylinder. A second fluid pressure cylinder pays out and retracts one end portion of the wire line of a block and tackle unit for elevating and lowering a fluid pressure operated reciprocating unit axially disposed on a post top to be driven into the ground.

U.S. Pat. No. 5,107,935 describes an accessory for a jackhammer comprising a clamping means for gripping the upper end of the stake so that the user can controllably drive the stake into the ground. The accessory includes a stake receiver that has a channel into which the end portion of the stake is inserted and further includes a jaw and clamping means for forcibly retaining the jaw against the inserted stake. The channel includes guide ways that permit it to be used interchangeably with the more common sizes and shapes of stakes.

U.S. Pat. No. 5,088,567 shows a device having a plurality of guides and a striking mass movable by a hydraulic cylinder. The hydraulic cylinder is arranged with its longitudinal axis outside the path of the center of gravity of the striking mass. The striking mass can comprise a first elastomeric and/or plastic component and a second heavy metal component. Three guides, which can be parallel to the movement path of the center of gravity, are provided for guidance of the striking mass, the striking mass is preferably constructed to be guided at its respective areas.

U.S. Pat. No. 5,010,710 shows rods, tubes posts, and the like rod structures driven into the ground by a device which is successively clamped to selected intermediate portions of the lengths of these rods to avoid heretofore involved awkwardness, instability, and unsafe driving conditions encountered when the top ends of long rods are engaged to force the rods into the ground. The device is easily and quickly clamped to the rod at a level close to the ground to be impacted by a driving tool such as a jackhammer at a convenient reachable level, it is easily released from the rod and raised to a starting level and then reclamped for the next driving increment. The successive raising and driving steps are repeated until the rod is driven to a desired depth in the ground. When the top end of the rod approaches ground level, the device can be mounted over this end and impacted to drive the rod further into the ground. A driving shank is slidably retained in a socket of the device spaced laterally from the clamp rod and inclined toward the rod so that the device will deliver type impact blow substantially along the axis of the rod to minimize bending. The device is especially useful for rods, which drive ground anchors into the ground.

U.S. Pat. No. 5,819,857 describes a portable power driven post driver having an inner hollow cylinder open at its upper end and adapted to receive a post through a locking mechanism located at its lower end. The inner cylinder is located within an outer surface of the outer cylinder; the longitudinal axes of the two fluid powered cylinders being in alignment. A common piston rod extends between the two pistons and is attached by a fastening member to the inner cylinder, the fastening member extending through a slot in the outer cylinder. A valve receives compressed fluid, such as compressed air, and cyclically and alternately directs the compressed fluid to the two fluid powered cylinders to alternately raise the outer cylinder above the inner cylinder and to drive the upper cylinder downwardly into post driving contact with the upper end of a post held by the inner cylinder.

U.S. Pat. No. 4,665,994 teaches a portable hand held post driver which is fully operable by a single worker and which uses a fluid powered cylinder to drive posts into the ground. The cylinder raises a balanced driving weight and forces the weight down onto the post. The cylinder is reversed automatically at both the top and bottom of its stroke to automatically repeat the driving strokes so long as the operator holds a hand lever. The post is clamped to the frame of the implement by a clamp having an overcenter control linkage. Before the implement can be operated, a safety-linking pin must be intentionally released by operating a safety lever.

Additional examples of the prior art are found in U.S. Pat. No. 839,246; 904,528; 1,102,652; 2,703,479; 3,036,482; 4,665,994 and 4,872,514.

SUMMARY OF THE INVENTION

The present invention relates to a stake/post driver comprising a hammer assembly and a hammer guide assembly for use with a handheld jackhammer to mechanically drive a stake or post into the ground or other support surface.

The hammer assembly comprises a hammer element configured to strike the stake or post coupled to the handheld jackhammer by a hammer spindle. The hammer element comprises a hammer member having a centrally disposed tapered recess formed therein to receive the lower portion of the hammer spindle. The hammer spindle includes a bit formed on the upper portion thereof to couple the stake/post driver to the handheld jackhammer and a tapered lower portion to be press fit into the centrally disposed tapered recess.

The hammer guide assembly comprises a hammer housing to receive the hammer element and a portion of the hammer spindle therein having an upper spindle guide formed on the upper portion thereof to receive a portion of the hammer spindle therethrough and a lower stake/post guide coupled to the lower portion thereof to receive a portion of the stake or post therethrough to cooperatively align the hammer element relative to the stake or post during operation of the stake/post driver.

The stake/post driver may further include a hammer assembly limit to limit the longitudinal movement of the hammer assembly relative to the hammer housing to prevent the hammer member element from engaging of the lower stake/post guide as the hammer assembly moves reciprocally within the hammer housing during operation of the stake/post driver.

In use, the upper end portion of a stake or post to be driven into the ground is placed through the centrally disposed guide aperture of the lower stake/post guide and into the lower portion of of the hammer housing. The handheld jackhammer provides the hammering force against the stake or post of sufficient magnitude and frequency to drive the stake or post end into the ground to the desired depth.

It should be noted that the hammer assembly is movable laterally relative to the hammer guide assembly such that the hammer element may be aimed or directed against the upper portion of the stake or post even when the post is not vertical; while, maintaining the lower portion of the hammer housing in surrounding relationship relative to the upper portion of the stake or post.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
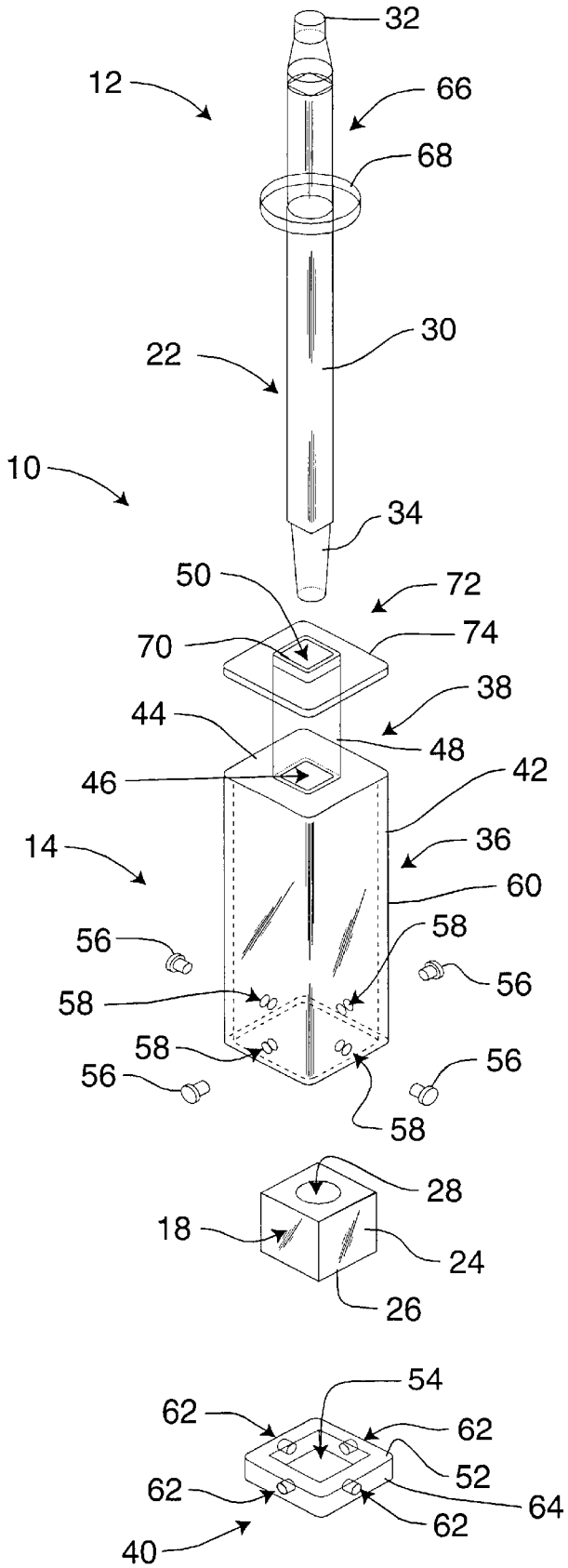
FIG. 1 is a perspective exploded view of the stake/post driver of the present invention.
Figure 2:
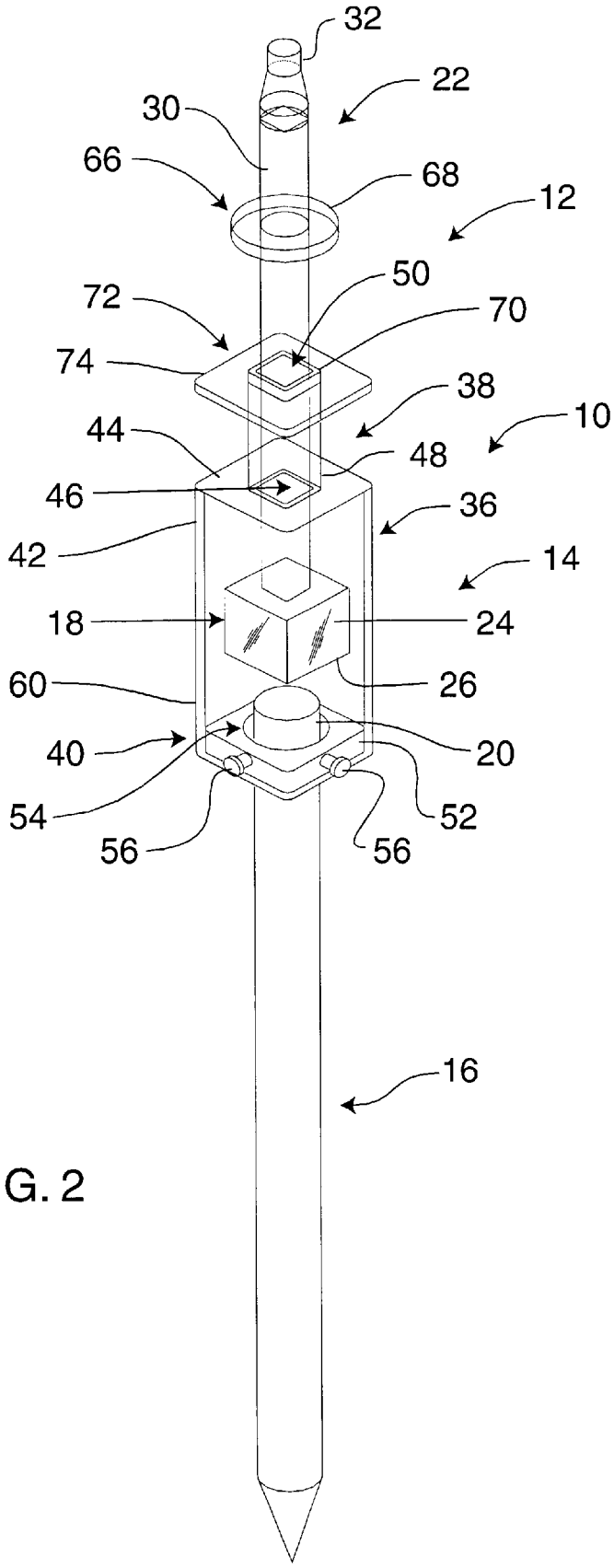
FIG. 2 is a perspective view of the stake/post driver of the present invention.
Figure 3:
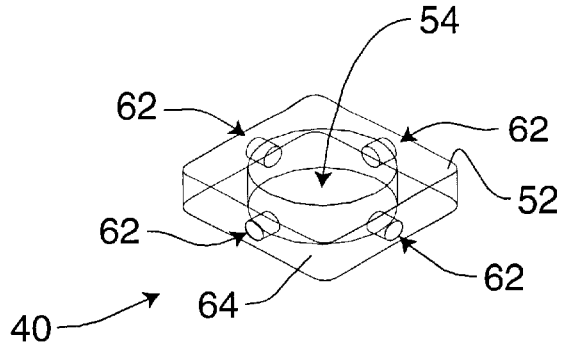
FIG. 3 is a perspective view of an alternative embodiment of the lower stake/post guide of the present invention.
Figure 4:
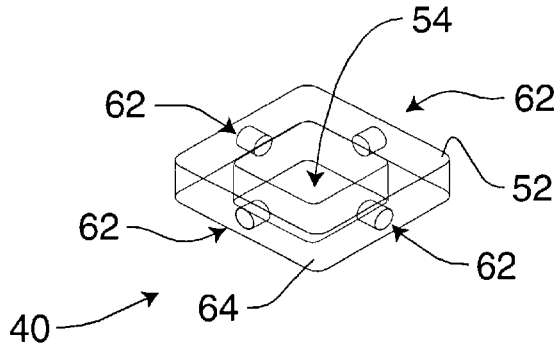
FIG. 4 is a perspective view of another alternative embodiment of the lower stake/post guide of the present invention.
Figure 5:
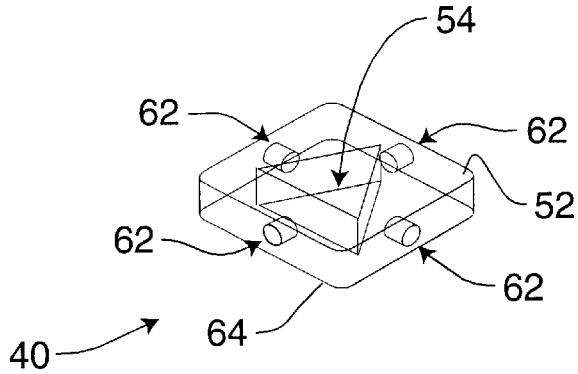
FIG. 5 is a perspective view of yet another alternative embodiment of the lower stake/post guide of the present invention.

As shown in FIGS. 1 and 2, the present invention relates to a stake/post driver generally indicated as 10 for use with a handheld jackhammer comprising a hammer assembly generally indicated as 12 and a hammer guide assembly generally indicated as 14 to mechanically drive a stake or post generally indicated as 16 into the ground or other support surface.

As shown in FIGS. 1 and 2, the hammer assembly 12 comprises a hammer element generally indicated as 18 configured to strike the upper portion 20 of the stake or post 16 coupled to the handheld jackhammer (not shown) by a hammer spindle generally indicated as 22.

The hammer element 18 comprises a substantially solid hammer member 24 with a substantially flat lower stake/post engaging surface 26 having a centrally disposed tapered recess 28 formed therein to receive the lower portion of the hammer spindle 22 as described more fully hereafter. The hammer spindle 22 comprises a substantially cylindrical elongated member 30 having a bit 32 formed on the upper portion thereof to couple the stake/post driver 10 to the handheld jackhammer (not shown) and a tapered lower portion 34 to press fit into the centrally disposed tapered recess 28 to removably secure the substantially cylindrical elongated member 30 to the substantially solid hammer member 24.

As shown in FIGS. 1 and 2, the hammer guide assembly 14 comprises a hammer housing generally indicated as 36 to receive the hammer element 18 and a portion of the hammer spindle 22 therein having an upper spindle guide generally indicated as 38 formed on the upper portion thereof to receive a portion of the hammer spindle 22 therethrough and a lower stake/post guide generally indicated as 40 coupled to the lower portion thereof to receive a portion of the stake or post 16 therethrough to cooperatively align the hammer element 18 relative to the stake or post 16 during operation of the stake/post driver 10.

The hammer housing 36 comprises a hollow substantially rectilinear sleeve 42 having a closed upper end formed by an upper end plate 44 having a centrally disposed aperture 46 formed therethrough and a open lower end. The upper spindle guide 38 comprises a hollow substantially rectilinear sleeve 48 having a guide channel 50 concentrically aligned with the centrally disposed aperture 46 extending outwardly from the upper end plate 44 to receive a portion the substantially cylindrical elongated member 30 of the hammer spindle 22. The lower stake/post guide 40 comprises a substantially flat lower guide plate 52 having a centrally disposed guide aperture 54 formed therethrough to receive the upper portion 20 of the stake or post therethrough 16 removably attached to the interior of the hollow substantially rectilinear sleeve 42 of the hammer sleeve 36 by a plurality of fasteners each indicated as 56 extending through a corresponding threaded aperture 58 formed in the lower portion of the sidewall 60 of the hollow substantially rectilinear sleeve 42 of the hammer sleeve 36 and into a corresponding threaded recess 62 formed on each side 64 of the substantially flat lower guide plate 52. Of course, the lower stake/post guide 40 can be affixed to the lower portion of the hammer housing 36.

As shown in FIGS. 1 and 3 through 5, the centrally disposed guide aperture 54 can be configured or shaped to receive an accommodate a stake or post 16 similarly shaped or configured such as square, circular, rectangular or triangular respectively.

As shown in FIGS. 1 and 2, the stake/post driver 10 further comprises a hammer assembly limit generally indicated as 66 to limit the longitudinal movement of the hammer assembly 12 relative to the hammer guide assembly 14 to prevent the substantially flat lower stake/post engaging surface 26 of the substantially solid hammer member 24 of the hammer element 18 from engaging of the lower stake/post guide 40 as the hammer assembly 12 moves reciprocally within the hammer guide assembly 14 during operation of the stake/post driver 10. The hammer assembly limit 66 comprises a hammer limit element 68 such as a collar or member extending outwardly from the upper portion of the substantially cylindrical elongated member 30 of the hammer spindle 22 to selectively engage the upper end 70 of the hollow substantially rectilinear sleeve 48 of the upper spindle guide 38. The distance between the lower surface of the hammer limit element 68 and the substantially flat lower stake/post engaging surface 26 is less than the distance between the upper end 70 of the hollow substantially rectilinear sleeve 48 of the upper spindle guide 38 and the upper surface of substantially flat lower guide plate 52 of the lower stake/post guide 40 such that when the hammer limit element 68 engages the upper end 70 of the hollow substantially rectilinear sleeve 48 of the upper spindle guide 38 the substantially solid hammer member 24 will be disposed in spaced relationship relative to the upper surface of the substantially flat lower guide plate 52 of the lower stake/post guide 40 to prevent engagement therebetween.

A protective member generally indicated as 72 is affixed to the upper portion of the hollow substantially rectilinear sleeve 48 of the upper spindle guide 38 to protect the hand and arm of a user grasping the of the hollow substantially rectilinear sleeve 48 of the upper spindle guide 38 during the use of the stake/post driver. The protective member 72 may comprise a flange 74 formed on the upper spindle guide 38.

To assemble, the appropriate lower stake/post guide 40 is selected and affixed to the lower portion of the hollow substantially rectilinear sleeve 48 with the plurality of fasteners 56. The bit 32 of the substantially cylindrical elongated member 30 of the hammer spindle 22 of the hammer assembly 12 is then attached to a handheld jackhammer (not shown).

In use, the upper end portion 20 of the stake or post 16 is placed through the centrally disposed guide aperture 54 of the lower stake/post guide 40 and into the lower portion of the hollow substantially rectilinear sleeve 48 of the upper spindle guide 38 of the hammer guide assembly 14. The handheld jackhammer (not shown) provides the hammering force to the stake or post 16 and of sufficient magnitude and frequency to due the drive the stake or post 16 into the ground to the desired depth.

It should be noted that the hammer assembly 12 is movable laterally relative to the hammer guide assembly 14 such that the substantially solid hammer member 24 may be aimed or directed against the upper portion 20 of the stake or post 16 that is not vertical; while, maintaining the lower portion of the hollow substantially rectilinear sleeve 48 of the hammer housing 36 of the hammer guide assembly 14 in surrounding relationship relative to the upper portion 20 of the stake or post 16.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A stake/post driver for use with a handheld jackhammer comprising a hammer assembly including a hammer element configured to strike the upper portion of the stake or post coupled to the handheld jackhammer by a hammer spindle to mechanically drive a stake or post into the ground or other support surface and a hammer guide assembly including a hammer housing to receive said hammer element and a portion of said hammer spindle therein having an upper spindle guide formed on the upper portion thereof to receive a portion of said hammer spindle therethrough and a lower stake/post guide coupled to the lower portion thereof to receive a portion of the stake or post therethrough to cooperatively align said hammer element relative to the stake or post during operation of said stake/post driver such that said hammer element strikes the upper portion of the stake or post into the ground or other support surface.

2. The stake/post driver of claim 1 wherein said hammer element comprises a hammer member having a centrally disposed recess formed therein to receive the lower portion of said hammer spindle and said hammer spindle comprises a elongated member having an upper portion to couple said stake/post driver to the handheld jackhammer and a lower tapered portion to press fit into said centrally disposed tapered recess to removably secure the said elongated member to the said hammer member.

3. The stake/post driver of claim 2 wherein said hammer guide assembly comprises a hammer housing to receive said hammer element and a portion of said hammer spindle therein having an upper spindle guide formed on the upper portion thereof to receive a portion of said hammer spindle therethrough.

4. The stake/post driver of claim 3 wherein said hammer housing comprises a hollow sleeve having a closed upper end having a centrally disposed aperture formed therethrough and a open lower end.

5. The stake/post driver of claim 4 wherein said upper spindle guide comprises a hollow sleeve having a guide channel concentrically aligned with said centrally disposed aperture extending outwardly from said closed upper end to receive a portion said substantially cylindrical elongated member of said hammer spindle.

6. The stake/post driver of claim 1 wherein said lower stake/post guide comprises a lower guide plate having a centrally disposed guide aperture formed therethrough to receive the upper portion of the stake or post therethrough attached to said hammer housing.

7. The stake/post driver of claim 6 wherein by a plurality of fasteners extend through a corresponding plurality of threaded apertures formed in the lower portion of the sidewall of said hammer housing and into a corresponding threaded recess formed in said lower stake/post guide.

8. The stake/post driver of claim 7 wherein said centrally disposed guide aperture is shaped to receive a similarly shaped stake or post.

9. The stake/post driver of claim 6 wherein said lower stake/post guide is affixed to the lower portion of the hammer housing.

10. The stake/post driver of claim 9 wherein said centrally disposed guide aperture is shaped to a similarly shaped stake or post.

11. The stake/post driver of claim 1 further comprising a hammer assembly limit to limit the longitudinal movement of said hammer assembly relative to said hammer guide assembly to prevent the said hammer element from engaging of said lower stake/post guide as said hammer assembly moves reciprocally within said hammer guide assembly during operation of said stake/post driver.

12. The stake/post driver of claim 11 wherein said hammer assembly limit comprises a hammer limit element extending outwardly from the upper portion of said hammer spindle to selectively engage the upper end said hammer guide assembly wherein the distance between the lower surface of said hammer limit element and the lower surface of said hammer element is less than the distance between the upper end of said hammer guide assembly and the upper surface of said lower stake/post guide.

13. The stake/post driver of claim 1 wherein a protective member is affixed to the upper portion of said upper spindle guide to protect the hand and arm of a user during the use of said stake/post driver.

14. The stake/post driver of claim 1 wherein said hammer guide assembly comprises a hammer housing to receive said hammer element and a portion of said hammer spindle therein having an upper spindle guide formed on the upper portion thereof to receive a portion of said hammer spindle therethrough.

15. The stake/post driver of claim 14 wherein said hammer housing comprises a hollow sleeve having a closed upper end having a centrally disposed aperture formed therethrough and a open lower end.

16. The stake/post driver of claim 15 wherein said hammer element comprises a hammer member having a centrally disposed recess formed therein to receive the lower portion of said hammer spindle and said hammer spindle comprises a elongated member having an upper portion thereof to couple said stake/post driver to the handheld jackhammer and a lower portion to press fit into the centrally disposed tapered recess to removably secure the said elongated member to the said hammer member.

17. The stake/post driver of claim 16 wherein said upper spindle guide comprises a hollow sleeve having a guide channel concentrically aligned with said centrally disposed aperture extending outwardly from the upper end plate to receive a portion hammer spindle.

18. The stake/post driver of claim 17 wherein said lower stake/post guide comprises a lower guide plate having a centrally disposed guide aperture formed therethrough to receive the upper portion of the stake or post therethrough attached to said hammer housing.

19. The stake/post driver of claim 18 wherein by a plurality of fasteners extend through a corresponding plurality of threaded apertures formed in the lower portion of the sidewall of said hammer housing and into a corresponding threaded recess formed in of said lower stake/post guide.

20. The stake/post driver of claim 19 wherein said centrally disposed guide aperture is shaped to receive a similarly shaped stake or post.

21. The stake/post driver of claim 19 wherein said lower stake/post guide is affixed to the lower portion of said hammer housing.

22. The stake/post driver of claim 21 wherein said centrally disposed guide aperture is shaped to receive a similarly shaped stake or post.

23. The stake/post driver of claim 18 further comprising a hammer assembly limit to limit the longitudinal movement of said hammer assembly relative to said hammer guide assembly to prevent said hammer element from engaging of said lower stake/post guide as said hammer assembly moves reciprocally within said hammer guide assembly during operation of said stake/post driver.

24. The stake/post driver of claim 23 wherein said hammer assembly limit comprises a hammer limit element extending outwardly from the upper portion of said hammer spindle to selectively engage the upper end of said hammer guide assembly the distance between the lower surface of said hammer limit element and the lower surface of said hammer element is less than the distance between the upper end of said hammer guide assembly and the upper surface of said flat lower guide plate of the lower stake/post guide.

25. The stake/post driver of claim 18 wherein a protective member is affixed to the upper portion of said upper spindle guide to protect the hand and arm of a user grasping during the use of said stake/post driver.

26. A stake/post driver for use with a handheld jackhammer comprising a hammer assembly including a hammer element configured to strike the upper portion of the stake or post coupled to the handheld jackhammer by a hammer spindle to mechanically drive a stake or post into the ground or other support surface and a hammer guide assembly including a hammer housing to receive said hammer element and a portion of said hammer spindle therein having an upper spindle guide formed on the upper portion thereof to receive a portion of said hammer spindle therethrough to align said hammer element relative to the stake or post during operation of said stake/post driver such that said hammer element strikes the upper portion of the stake or post into the ground or other support surface.

27. The stake/post driver of claim 26 further including a lower stake/post guide coupled said hammer housing to receive a portion of the stake or post therethrough to cooperatively align the hammer element relative to the stake or post during operation of said stake/post driver.

28. The stake/post driver of claim 27 further comprising a hammer assembly limit to limit the longitudinal movement of said hammer assembly relative to said hammer guide assembly to prevent said hammer element from engaging of said lower stake/post guide as said hammer assembly moves reciprocally within said hammer guide assembly during operation of said stake/post driver.

29. The stake/post driver of claim 28 wherein said hammer element comprises a hammer member having a centrally disposed recess formed therein to receive the lower portion of said hammer spindle and said hammer spindle comprises a elongated member having an upper portion to couple said stake/post driver to the handheld jackhammer and a lower tapered portion to press fit into said centrally disposed tapered recess to removably secure the said elongated member to the said hammer member, said hammer guide assembly comprises a hammer housing to receive said hammer element and a portion of said hammer spindle therein having an upper spindle guide formed on the upper portion thereof to receive a portion of said hammer spindle therethrough, the hammer housing comprises a hollow sleeve having a closed upper end having a centrally disposed aperture formed therethrough and a open lower end and said upper spindle guide comprises a hollow sleeve having a guide channel concentrically aligned with the centrally disposed aperture extending outwardly from the upper end plate to receive a portion said elongated member of the hammer spindle.

30. The stake/post driver of claim 29 wherein said lower stake/post guide comprises a lower guide plate having a centrally disposed guide aperture formed therethrough to receive the upper portion of the stake or post therethrough attached to the interior of said hammer sleeve.

31. The stake/post driver of claim 28 wherein a protective member is affixed to the upper portion of said upper spindle guide to protect the hand and arm of a user during the use of said stake/post driver.

* * * * *